US008036554B2

(12) United States Patent
Tenjiku

(10) Patent No.: US 8,036,554 B2
(45) Date of Patent: Oct. 11, 2011

(54) IMAGE FORMING APPARATUS AND DENSITY CORRECTION METHOD

(75) Inventor: Eiji Tenjiku, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 338 days.

(21) Appl. No.: 12/369,497

(22) Filed: Feb. 11, 2009

(65) Prior Publication Data

US 2009/0220254 A1 Sep. 3, 2009

(30) Foreign Application Priority Data

Feb. 29, 2008 (JP) ..... 2008-050645

(51) Int. Cl.
*G03G 15/00* (2006.01)

(52) U.S. Cl. ..... 399/49; 399/72; 399/258

(58) Field of Classification Search ..... 399/9, 27, 399/29, 30, 38, 49, 53, 58–64, 72, 258, 260
See application file for complete search history.

(56) References Cited

U.S. PATENT DOCUMENTS 5,826,136 A * 10/1998 Saiko et al. ..... 399/49
6,115,561 A 9/2000 Fukushima
2002/0028083 A1* 3/2002 Hirobe et al. ..... 399/49
2003/0138259 A1* 7/2003 Watanabe et al. ..... 399/30
2005/0063715 A1* 3/2005 Suzuki et al. ..... 399/27

FOREIGN PATENT DOCUMENTS

JP 07-333967 A 12/1995
JP 10-39555 A 2/1998
JP 11-095536 A 4/1999
JP 2007-225813 A 9/2007

* cited by examiner

*Primary Examiner* — David Porta
*Assistant Examiner* — Benjamin Schmitt
(74) *Attorney, Agent, or Firm* — Birch, Stewart, Kolasch & Birch, LLP

(57) ABSTRACT

When a two-component developer stored in a developer tank has been replaced, an image forming apparatus performs (a) a first formation step of forming a reference toner image on a photoreceptor, (b) a detection step of detecting an amount of toner of the reference toner image, and (c) a supply step of supplying a predetermined amount of toner to the developer tank when the amount of toner detected in the detection step is less than a threshold. Moreover, the image forming apparatus repeats the first formation step, the detection step, and the supply step until the amount of toner detected in the detection step becomes not less than the threshold. This makes it possible to provide an image forming apparatus that is stable in image quality even immediately after replacement of developers.

5 Claims, 6 Drawing Sheets

IMAGE FORMING APPARATUS AND DENSITY CORRECTION METHOD

This Nonprovisional application claims priority under U.S.C. §119(a) on Patent Application No. 050645/2008 filed in Japan on Feb. 29, 2008, the entire contents of which are hereby incorporated by reference.

FIELD OF THE INVENTION

The present invention relates to an electrophotographic image forming apparatus including a developing device that develops, with toner, an electrostatic latent image formed on a surface of a photoreceptor.

BACKGROUND OF THE INVENTION

An image forming apparatus for electrophotographically forming an image on a sheet includes a photoreceptor drum, a charging device, an exposure device, a developing device, a transfer device, a fixing device, a cleaning device, and a charge-removing device. In the image forming apparatus, the charging device uniformly charges a surface of the photoreceptor drum with the photoreceptor drum driven to rotate. The photoreceptor drum thus charged is irradiated with laser light by the exposure device, with the result that an electrostatic latent image is formed on the photoreceptor drum.

Then, the developing device develops, with toner, the electrostatic latent image formed on the photoreceptor drum, with the result that a toner image is formed on the photoreceptor drum as a visible image. The toner image formed on the photoreceptor drum is transferred onto a sheet (transfer receiving material, recording material, paper sheet) by the transfer device. The toner image transferred onto the sheet is pressed and heated by the fixing device so as to be fixed onto the sheet, with the result that an image is formed on the sheet.

Meanwhile, the toner remaining on the photoreceptor drum without being transferred to the sheet is removed from the photoreceptor drum by the cleaning device, and then collected in a predetermined collecting section. After the cleaning, the charge remaining on the photoreceptor drum is removed by the charge-removing device.

As a developer that is stored in the developing device to develop the electrostatic latent image formed on the photoreceptor drum, a one-component developer composed solely of toner or a two-component developer composed of toner and carrier is used.

A developing device in which the one-component developer is stored does not use carrier, and therefore does not need to include a stirring mechanism for uniformly mixing toner and carrier. This brings about an advantage of making it possible to design a developing device simply, but brings about a disadvantage of making it difficult to stabilize the amount of charge of toner.

A developing device in which the two-component developer is stored needs to include a stirring mechanism for uniformly mixing toner and carrier. This brings about a disadvantage of complicating the structure of a developing device, but brings about excellent stability in the amount of charge of toner and excellent compatibility with a high-speed machine. Therefore, the two-component developer is heavily used in a high-speed image forming apparatus and a color image forming apparatus.

In order to form a high-quality image, an image forming apparatus in which the two-component developer is used needs to maintain, at an appropriate value of density (target value), the toner density of a developer stored in a developer tank of a developing device. Accordingly, the developing device detects the magnetic permeability of the developer, for example, as an index of toner density of the developer, and is supplied with toner from a toner bottle when the toner density falls short of the target value, i.e., when the value of the detected magnetic permeability exceeds a reference value of magnetic permeability serving as a reference value for determining whether to supply toner. With this, the toner density of the two-component developer stored in the developer tank is held in the vicinity of the target value.

Further, in the image forming apparatus in which the two-component developer is used, the two-component developer deteriorates when used over time. Therefore, the two-component developer stored in the developing device needs to be replaced with a brand-new two-component developer regularly or irregularly.

It should be noted here that the toner density of the brand-new two-component developer to be newly stored in the image forming apparatus has been adjusted to density suitable for the development characteristics of the image forming apparatus (i.e., to the target value). However, the brand-new two-component developer often differs in properties from the running two-component developer that has been used in the image forming apparatus to some extent. Therefore, there have been cases where the first to several-thousandth images formed after replacement of two-component developers suffer from instability in image density.

In order to suppress a difference in properties of two-component developer between before and after replacement, Patent Document 1 discloses a technique by which the toner density of a brand-new developer is set to be lower than an appropriate level of toner density (i.e., than the target value) for use in an image forming apparatus and the toner density of the two-component developer is raised (i.e., corrected) to the target value by stirring the developer with the developer supplied with toner from a toner bottle immediately after replacement.

(Patent Document 1)

Japanese Unexamined Patent Application Publication No. 95536/1999 (Tokukaihei 11-95536; published on Apr. 9, 1999)

However, in order to stabilize the quality of images that are formed immediately after replacement of two-component developers, it is insufficient to suppress a difference in properties of two-component developer between before and after replacement. The following gives a reason for this.

A large number of mass-produced image forming apparatuses inevitably vary from one another in dimensional accuracy such as the distance between a doctor blade and a developing roller (such a distance being hereinafter referred to as "DG") and the distance between a photoreceptor drum and a developing roller (such a distance being hereinafter referred to as "DSD") (manufacturing errors). As a result of their diligent study, the inventors have found that the variations in DG and DSD cause instability in density of the first to several-thousandth images formed after replacement of two-component developers. It should be noted here that the finding that the variations in DG and DSD cause the instability has been brought to light by the inventors and was not obvious at the time of the present invention. The following further details the finding that the variations in DG and DSD cause the instability. It should also be noted that the following description has been brought to light by the inventors and was not obvious at the time of the present invention.

The optimum value of toner density of a two-component developer from the first to several-thousandth images after replacement of two-component developers slightly varies depending on differences in DG and DSD. That is, immediately after replacement of two-component developers, the optimum value of toner density of a two-component developer slightly shifts from the target value, depending on the values of DG and DSD.

FIG. 6 is a graph showing a relationship between the developing potential and image density ID of an image formed in cases where the toner density of a two-component developer is appropriate. FIG. 7 is a graph showing a relationship between the developing potential and image density ID of an image formed in cases where the toner density of a two-component developer is higher than the optimum value. FIG. 8 is a graph showing a relationship between the developing potential and image density ID of an image formed in cases where the toner density of a two-component developer is lower than the optimum value. The "developing potential" here means the absolute value of a difference between the surface potential of a photoreceptor drum and the potential of a developing roller. Further, FIGS. 6 through 8 assume that the potential of a developing roller is −500 V.

In cases where the toner density of a two-component developer is higher than the optimum value as shown in FIG. 7, the gamma value (the slope of a function of developing potential and image density ID) becomes so high that the reproducibility of halftone density (ID=0.5 to 0.8) deteriorates, although the density of a solid image can be improved. In the case of a wide DG or a narrow DSD, the toner density of a two-component developer tends to be higher than the optimum value. Further, in cases where the toner density of a two-component developer is lower than the optimum value as shown in FIG. 8, the image density ID of a high-density side becomes so low that it becomes difficult to form a high-density image.

As a result of the foregoing study, in order to stabilize image quality even immediately after replacement of two-component developers, it is necessary not only to correct the toner density of a two-component developer after replacement so as to suppress a difference in properties of two-component developer between before and after replacement, but also to correct the toner density of a two-component developer after replacement so that the toner density takes on a value suitable for the values of DG and DSD.

SUMMARY OF THE INVENTION

It is an object of the present invention to provide an electrophotographic image forming apparatus that is stable in image quality even immediately after replacement of two-component developers.

An image forming apparatus of the present embodiment includes: a photoreceptor; an exposure device that forms an electrostatic latent image on the photoreceptor by exposing the photoreceptor; a developing device including (i) a developer tank in which a two-component developer containing toner and carrier has been stored and (ii) a developing roller that forms a toner image on the photoreceptor by supplying, to the electrostatic latent image formed on the photoreceptor, the toner contained in the two-component developer stored in the developer tank; a supply device that corrects a toner density of the two-component developer by supplying toner to the developer tank; a detection device that detects an amount of toner of the toner image formed on the photoreceptor; and a control device that controls operation of each of the photoreceptor, the exposure device, the developing device, the supply device, and the detection device, upon detection of replacement of the two-component developer stored in the developer tank, the control device controlling the operation so that a density correction process is performed, the density correction process being a process, including (a) a first formation step of forming a reference toner image on the photoreceptor, (b) a first detection step of detecting an amount of toner of the reference toner image, and (c) a supply step of supplying a predetermined amount of toner to the developer tank when the amount of toner detected in the first detection step is less than a threshold, by which process the supply step, the first formation step, and the first detection step are repeated in this order until the amount of toner detected in the first detection step becomes not less than the threshold.

The image forming apparatus of the present invention is arranged such that immediately after replacement of the two-component developer, toner is supplied into the developer tank so that the amount of toner adhering to a reference toner image actually formed on the photoreceptor reaches the threshold. Therefore, the image forming apparatus of the present embodiment is arranged such that the toner density of the two-component developer stored in the developer tank is adjusted so that the density of a reference toner image that is formed on the photoreceptor takes on the desired value.

This makes it possible that even if there are variations in DSD and DG among image forming apparatuses, the optimum toner density (i.e., such toner density of the two-component developer that the density of an image formed on the photoreceptor takes on the optimum value) is realized for each image forming apparatus regardless of the variations. In other words, the present embodiment is such that immediately after replacement of the two-component developer, the toner density of the developer stored in the developer tank is adjusted to the optimum value for conditions (quality of each production lot) unique to the developer and conditions (development conditions such as DSD and DG) unique to the developing device. This makes it possible that even immediately after replacement of the two-component developer, images having a certain level of density can be stably formed, thus stabilizing image quality.

Further, in such a case that the toner density is raised at once to not less than the threshold by performing the supply step only once, there is a danger that the toner density becomes excessively high. On the other hand, the image forming apparatus of the present invention is arranged such that the supply step, the first formation step, and the first detection step are repeated in this order until the amount of toner detected in the first detection step becomes not less than the threshold. Therefore, if the present invention is arranged such that the predetermined amount and the toner density of the developer immediately after replacement are defined so that the supply step is performed more than once, it is possible to gradually raise the toner density of the developer stored in the developer tank, instead of raising the toner density at once. This makes it possible to lessen the danger of an excessive rise in toner density.

Additional objects, features, and strengths of the present invention will be made clear by the description below. Further, the advantages of the present invention will be evident from the following explanation in reference to the drawings.

DESCRIPTION OF THE EMBODIMENTS

An embodiment of the present invention will be described below with reference to the drawings. It should be noted that the embodiment below is a concrete example of the present invention and, as such, does not limit the technical scope of the present invention.

[Image Forming Apparatus]

Figure 1:
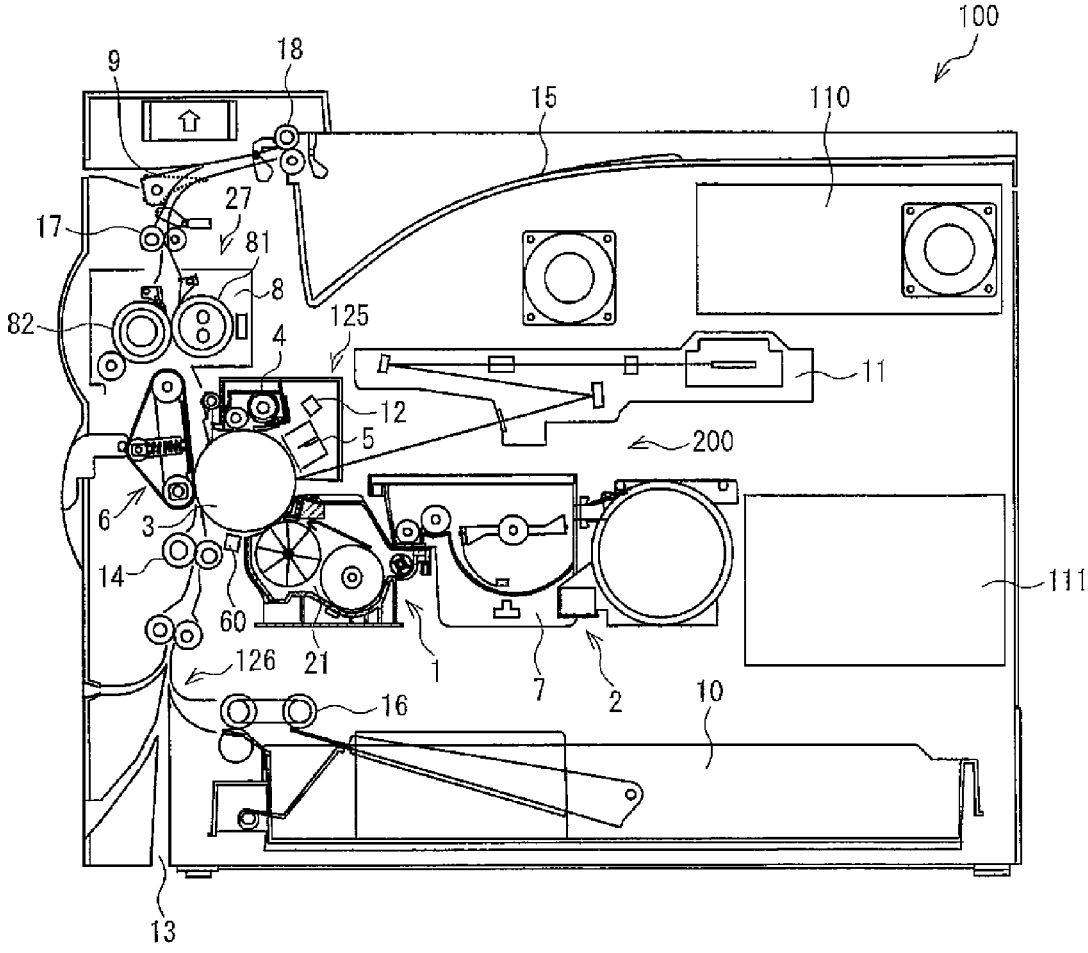
FIG. 1 shows an internal structure of an image forming apparatus according to an embodiment of the present invention.

FIG. 1 is a schematic diagram showing an arrangement of an image forming apparatus 100 of the present embodiment. The image forming apparatus 100 of FIG. 1 is an electrophotographic printer that forms a monochrome image on a sheet (recording medium) in accordance with image information transmitted via a network from an external device such as a personal computer, a digital camera, or a DVD recorder, or in accordance with image information read by a scanner device (not shown) of the image forming apparatus 100.

The image forming apparatus 100 includes an image forming section 125, a sheet feeding section 126, an image fixing section 27, a control device 110, and a power supply device 111.

The power supply device 111 is a device, disposed below the after-mentioned exposure unit 11, which serves to supply power to the image forming section 125, the sheet feeding section 126, the image fixing section 27, the control device 110.

The image forming section 125 includes a photoreceptor drum 3, a charging device 5, an exposure unit 11, a developing device 200, a transfer device 6, a cleaning unit 4, and a charge-removing device 12. The charging device 5, the exposure unit 11, the developing device 200, the transfer device 6, the cleaning unit 4, and the charge-removing device 12 are arranged in this order along the rotation direction of the photoreceptor drum 3 around the photoreceptor drum 3.

The photoreceptor drum (photoreceptor) 3 is a roller-like member provided so as to be able to be driven by a driving source (not shown) to rotate on the axis of the drum. The photoreceptor drum 3 is realized, for example, by a roller-like member including a cored bar and a photosensitive layer formed on a surface of the cored bar. The cored bar is formed by metal such as aluminum or stainless steel. The photosensitive layer can be realized, for example, by a laminate composed of a resin layer containing a charge generating substance and a resin layer containing a charge transporting substance. It should be noted that an electrostatic latent image and then a toner image are formed on the photosensitive layer.

The charging device 5 charges a surface of the photoreceptor drum 3 at a predetermined polarity and a predetermined potential. The charging device 5 can be realized, for example, by a noncontact charger or a contact roller-type charger or brush-type charger.

The exposure unit (exposure device) 11 irradiates, with signal light based on image information, that surface of the photoreceptor drum 3 which has been charged by the charging device 5, and thereby forms an electrostatic latent image on the surface of the photoreceptor drum 3. The exposure unit 11 can be realized, for example, by a laser scanning unit including a laser irradiation section such as a semiconductor laser and a reflection mirror.

The developing device 200 develops an inversion of the electrostatic latent image by supplying toner to the electrostatic latent image formed on the surface of the photoreceptor drum 3 and thereby forms a toner image as a visible image. It should be noted that an arrangement of the developing device 200 will be detailed later.

The transfer device 6 is a belt unit including a conductive roller, a supporting roller, and a belt stretched by these rollers so as to be pressed against the photoreceptor drum 3. The belt of the transfer device 6 is provided so as to be revolved by the conductive roller and the supporting roller. Further, the area where the belt of the transfer device 6 is pressed against the photoreceptor drum 3 is a transfer nip area. Moreover, the conductive roller of the transfer device 6 has an electrical field applied thereto, and the electrical field causes a transfer bias to be generated between the photoreceptor drum 3 and the transfer device 6. The transfer bias causes the toner image formed on the surface of the photoreceptor drum 3 to be transferred onto a sheet at the transfer nip area. It should be noted that the sheet is fed to the transfer nip area so that the top edge of the sheet is aligned with the top edge of the toner image (image) formed on the photoreceptor drum 3.

The cleaning unit 4 removes and collects toner remaining on the surface of the photoreceptor drum 3 after the toner image has been transferred onto the sheet. The cleaning unit 4 includes a cleaning blade. An example of the cleaning blade is a plate-like member, made of elastic material, which is provided so as to make contact with the surface of the photoreceptor drum 3. The cleaning blade scrapes toner and paper powder remaining on the surface of the photoreceptor drum 3 after the toner image has been transferred onto the sheet.

The charge-removing device 12, constituted by a charge-removing lamp and the like, removes charge remaining on the surface of the photoreceptor drum 3 after the cleaning.

In the image forming section 125 thus described, an electrostatic latent image is formed on the surface of the photoreceptor drum 3 through the charging of the surface of the photoreceptor drum 3 by the charging device 5 and through the irradiation of the surface of the photoreceptor drum 3 with signal light based on image information. A toner image is formed by the supply of toner from the developing device 200 to the electrostatic latent image, and then transferred onto a sheet by the transfer device 6. After the toner transfer, the surface of the photoreceptor drum 3 is purified by the removal of residual toner and the like by the cleaning unit 4 and by the removal of charge by the charge-removing device 12. Images are formed by repeatedly performing this series of operations.

The sheet feeding section 126 includes a tray 10, a pickup roller 16, and a registration roller 14.

The tray 10 is a tray for holding sheets such as standard paper, coated paper, color-copy paper, and OHP films. The supply of sheets to the tray 10 is performed by drawing out the tray 10 toward the front side (operation side) of the image forming apparatus 100. The pickup roller 16 separates one sheet from another and feeds one sheet at a time to the registration roller 14. The registration roller 14 sequentially feeds the sheets to the transfer nip area in accordance with the timing of exposure of the surface of the photoreceptor drum 3 by the exposure unit 11. That is, the sheet feeding section 126 feeds a sheet to the transfer nip area so that the top edge of the sheet is aligned with the top edge of a toner image (image) formed on the photoreceptor drum 3.

The image forming section 27 includes a fixing device 8, a conveyance roller 17, a switching gate 9, a reverse roller 18, and a loading tray 15.

The fixing device 8 includes a fixing roller 81 and a pressure roller 82. The fixing roller is a roller-like member provided so as to be able to be driven by a driving source (not shown) to rotate, and has a heating device provided therein. The heating device provided in the fixing roller 81 can be realized by a halogen lamp, an infrared lamp, or the like. The pressure roller 82 is a roller-like member, supported rotatably, which is provided so as to be pressed against the fixing roller 81. The area where the fixing roller 81 and the pressure roller 82 are pressed against each other is a fixing nip area. A sheet passing through the fixing nip area is subjected to heat by the fixing roller 81 and pressure by the pressure roller 82. In the fixing device 8, a sheet onto which a toner image has been transferred by the transfer device 6 is fed to the fixing nip area and subjected to heat and pressure, and the toner image is fixed onto the sheet, with the result that an image is formed on the sheet.

The conveyance roller 17 feeds, to the switching gate 9, the sheet finished with image formation, i.e., the sheet subjected to the fixing process by the fixing device 8. The switching gate 9 switches conveying paths for the sheet finished with fixing. Specifically, the sheet finished with image formation is conveyed to the reverse roller 18, a relay conveyance device (not shown), or a sheet refeeding conveyance device (not shown) by the switching gate 9.

The reverse roller 18 discharges, onto the loading tray 15, the sheet finished with image formation. Meanwhile, in the case of designation of double-side image formation, a post-process (e.g., a stapling process, a punching process), or the like, the reverse roller 18 reverses after discharging a part of the sheet in the direction of the loading tray 15 while nipping the sheet, and then feeds the sheet to the relay conveyance device or the sheet refeeding conveyance device via the switching gate 9 and a conveying path (not shown) provided on a side surface of the image forming apparatus 100. At this time, the switching gate 9 is displaced from the position indicated by the solid line to the position indicated by the dotted line. The loading tray 15 is a tray, provided on an upper outer portion of the image forming apparatus 100, which serves to hold sheets finished with image formation and then discharged from the image forming apparatus 100.

In the image fixing section 27, the fixing device 8 fixes a toner image onto a sheet. Then, the sheet finished with the fixing process is conveyed to the reverse roller 18 via the conveyance roller 17 and the switching gate 9, and then either discharged directly onto the loading tray 15, conveyed in the reverse direction by the reverse roller 18 so as to be fed to the relay conveyance device (not shown) or the sheet refeeding conveyance device (not shown) via the switching gate 9.

The control device 110 is a computer, disposed above the exposure unit 11, which serves to control the image forming apparatus 100 overall. Specifically, the control device 110 includes: a CPU (central processing unit); a ROM (read-only memory) storing a program that is executed by the CPU; a RAM (random access memory) that serves as a working area for the CPU; a memory in which various parameters and expressions (coefficients of the expressions) for use in processing by the CPU are stored; peripherals such as various sensors and a motor-driving driver; a control circuit substrate; an interface substrate for data input/data output; and the like.

Further provided on lower and side surfaces of the image forming apparatus 100 is an auxiliary conveying path (not shown) which, when the image forming apparatus 100 has an external device connected thereto, serves to convey a sheet from the image forming apparatus 100 to the external device or to convey a sheet from the external device to the image forming apparatus 100.

In the image forming apparatus 100, an electrostatic latent image is formed on the surface of the photoreceptor drum 3 in accordance with image information inputted to the control device 110, and the electrostatic latent image is developed and then transferred onto a sheet as a toner image. After that, the toner image is fixed onto the sheet through a fixing process. After the fixing process, the sheet is either discharged directly onto the loading tray 15, or subjected to a post-process, another image-forming step, etc.

[Developing Device]

Figure 2:
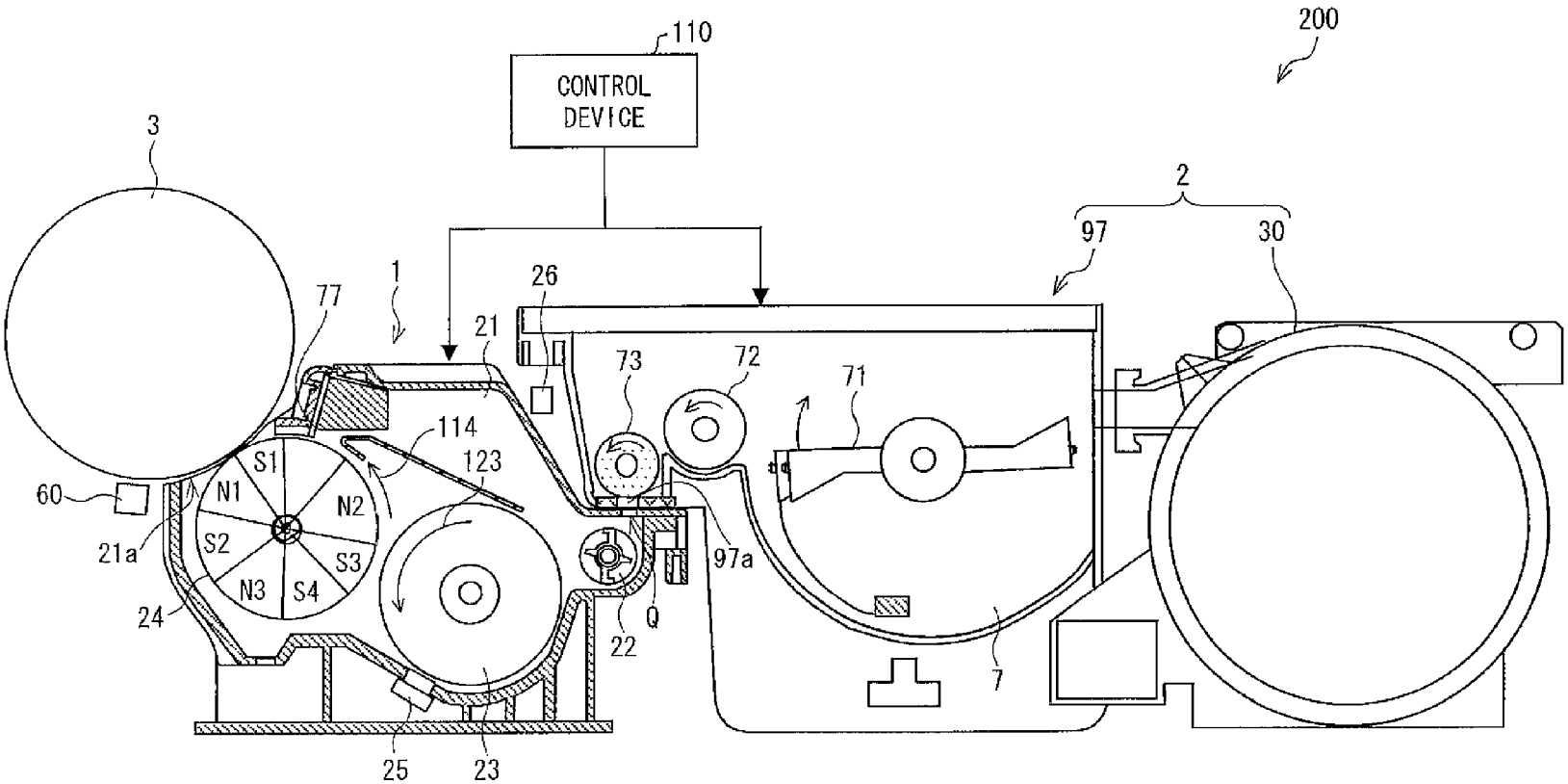
FIG. 2 shows a developing device of the image forming apparatus of FIG. 1.

The following details an arrangement of the developing device 200. FIG. 2 is a schematic diagram showing an arrangement of the developing device 200 according to the present embodiment.

The developing device 200 is mounted in the image forming apparatus 100, which forms an image electrophotographically, and forms a toner image by supplying toner to an electrostatic latent image formed on the surface of the photoreceptor drum 3. As shown in FIG. 2, the developing device 200 is constituted by a developing section 1 and a toner supply section 2. Further, as shown in FIG. 2, the control device 110 is in connection with the developing device 200.

The developing section 1 includes a developer tank 21, a developing roller 24, a supply roller 23, a stirring member 22, and a layer-thickness regulating member 77. The toner supply section 2 includes a toner hopper 97 and a toner bottle 30.

The developer tank 21 is a container-like member having an internal space in which a two-component developer (hereinafter referred to simply as "developer") is stored. It should be noted that the developer contains toner and carrier in the present embodiment.

The developer tank 21 is constituted by developer tank walls formed from a synthetic resin or, preferably, a thermoplastic resin that can be injection-molded. Further, the developer tank 21 houses the developing roller 24, the supply roller 23, and the stirring member 22, supports the developing roller 24, the supply roller 23, and the stirring member 22 rotatably, and supports the layer-thickness regulating member 77.

Among the developer tank walls constituting the developer tank 21, the developer tank wall on which the photoreceptor drum 3 has been disposed has an opening 21*a* formed therein. The developing roller 24 is disposed so as to face the photoreceptor drum 3 via the opening 21*a*.

Further, among the developer tank walls constituting the developer tank 21, the developer tank wall located above the stirring member 22 disposed in the developer tank 21 has an opening Q formed therein. The opening Q serves as a toner-receiving opening. Furthermore, as shown in FIG. 2, the toner hopper 97 is provided with a toner supply opening 97*a* disposed so as to overlap with the opening Q vertically. That is, the toner supply opening 97*a* and the opening Q communicates the interior of the toner hopper 97 to the interior of the developer tank 21.

The toner hopper 97 supplies toner into the developer tank 21 via the toner supply opening 97*a* and the opening Q in accordance with the state of toner consumption in the developer tank 21. The supply of toner from the toner hopper 97 into the developer tank 21 is achieved by the rotation of a toner supply roller 73 in the toner hopper 97. The toner supply roller 73 is provided above the toner supply opening 97*a* so as to slide on the outer edge of the toner supply opening 97*a* when rotating.

The developing roller 24 is driven by a driving source (not shown) to rotate on its axis in the direction of an arrow 114. The developing roller 24 is disposed in the vicinity of the opening 21*a* of the developer tank 21 so as to face the photoreceptor drum 3, separated from the photoreceptor drum 3 with a space therebetween, and is disposed so that the rotation axis of the photoreceptor drum 3 and the rotation axis of the developing roller 24 run parallel to each other.

Moreover, the developing roller 24 is driven to rotate with a toner layer carried on a surface thereof, supplies toner to an electrostatic latent image on the surface of the photoreceptor drum 3 in a developing nip area (i.e., an area where the photoreceptor drum 3 and the developing roller 24 are closest to each other), develops the electrostatic latent image, and forms a toner image. The power supply device 111 applies a developing bias voltage to the developing roller 24 in migrating toner from the developing roller 24 to the photoreceptor roller 3. In the present embodiment, the photoreceptor drum 3 and the developing roller 24 are provided so as to be separated from each other with a space therebetween. However, the present invention is not limited to this. The photoreceptor drum 3 and the developing roller 24 may be pressed against each other.

The supply roller 23 is a roller member provided so as to face the photoreceptor drum 3 with the developing roller 24 interposed therebetween. The supply roller 23 is driven by a driving source (not shown) to rotate on its axis in the direction of an arrow 123. When driven to rotate, the supply roller 23 rubs toner or toner and carrier stored in the internal space of the developer tank 21 and thereby charges the toner, and conveys the developer to the vicinity of the developing roller 24.

The stirring member 22 is a screw member provided below the opening Q so as to face the developing roller 24 with the supply roller 23 interposed therebetween. Moreover, the stirring member 22 is driven by a driving source (not shown) to rotate on its axis. When driven to rotate, the stirring member 22 uniformly mixes (i) toner supplied into the developer tank 21 via the opening Q, which serves as a toner-receiving opening, with (ii) toner already stored in the developer tank 21, and conveys the uniformly mixed toner to the vicinity of the supply roller 23.

The layer-thickness regulating member 77 is a plate-like member provided so that one end of its shorter sides is supported by the developer tank 21 and the other end is a free end separated from the surface of the developing roller 24 with a space therebetween. In the present embodiment, the space (DG) between the layer-thickness regulating member 77 and the developing roller 24 is approximately 0.9 mm. The layer-thickness regulating member 77 is adjusted so that the thickness of the developer layer carried on the surface of the developing roller 24 takes on a desired value. A preferred example of the layer-thickness regulating member 77 is a member that bends when subjected to bending moment. Examples of such a member include a plate spring made of metal and an elastic member (synthetic resin or rubber). Among these, in consideration of damage to the photoreceptor drum 3, rubber is preferred.

Further, in the present embodiment, as shown in FIGS. 1 and 2, a sensor (detection device) 60 for detecting the amount of adhering toner is provided between the developing device 200 and the transfer device 6 so as to be positioned in the vicinity of the photoreceptor drum 3. The sensor 60 is a photo-interrupter photoelectric element having a light-emitting element for irradiating the surface of the photoreceptor drum 3 with light and a light-receiving element for receiving light emitted from the light-emitting element to the photoreceptor drum 3 and reflected from the photoreceptor drum 3. Moreover, the sensor 60 measures, in accordance with the amount of light received by the light-receiving element, the amount of toner adhering to a toner image formed on the surface of the photoreceptor drum 3 (i.e., the amount of toner adhering per unit area). It should be noted that the light-emitting element may emit visible light or infrared light.

In the case of an image forming apparatus employing an intermediate-transfer system (second-transfer system), it is possible to provide a reflecting optical sensor between an area of first transfer (area of contact between a photoreceptor drum 3 and an intermediate transfer belt) and a cleaning device so that the reflecting optical sensor is positioned in the vicinity of the photoreceptor drum 3, and to measure the amount of adhering toner by the reflecting optical sensor.

Furthermore, as shown in FIG. 2, the developer tank 21 has a magnetic permeability sensor 25 attached onto an outer wall thereof so as to face the supply roller 23 housed in the developer tank 21. The magnetic permeability sensor 25 is a sensor capable of measuring the magnetic permeability of the developer stored in the developer tank 21. In the present embodiment, the toner density of the developer stored in the developer tank 21 is measured in accordance with an output of the magnetic permeability sensor 25. Specifically, when the developer flows in the vicinity of the magnetic permeability sensor 25, the developer acts as a core to change inductance between coils provided in the magnetic permeability sensor 25. The magnitude of inductance is determined by the amount of magnetic carrier particles contained in (magnetic permeability of) the developer acting as a core. Therefore, the amount of magnetic particles contained in the developer stored in the developer tank 21 and then the toner density of the developer can be measured by a voltage outputted from the coils of the magnetic permeability sensor 25.

As shown in FIG. 2, the toner supply section (supply device) 2 is constituted by the toner bottle 30 and the toner hopper 97. Further, as shown in FIG. 2, the toner hopper 97 includes a toner supply tank 7, a stirring member 71, a toner conveyance roller 72, and a toner supply roller 73.

The toner bottler 30 is a toner cartridge in which toner is stored and which is replaced when emptied of toner. The toner hopper 97 causes toner supplied from the toner bottle 30 to be stored temporarily in the toner supply tank 7, and supplies the toner into the developer tank 21 at appropriate timing.

Further, the stirring member 71, provided in the toner supply tank 7, serves to stir the toner stored in the toner supply tank 7. The toner conveyance roller 72 is a roller for conveying, to the toner supply opening 97*a*, the toner stored in the toner supply tank 7. The toner supply roller 73 is a roller for supplying the toner from the toner hopper 97 into the developer tank 21 via the toner supply opening 97*a* and the opening Q. The control device 110 controls the rotation of the toner supply roller 73, thereby controlling the supply of toner to the developer tank 21 so that the amount of toner to be supplied is adjusted.

Further, the control device 110 has functions to control the activation, operation, and stoppage of each component of the image forming section 125 including the developing device 200 and to serve as a data storage section for storing data necessary for the control. Furthermore, the control device 110 controls the operation of the toner supply roller 73 in accordance with the toner density measured by the value of output of the magnetic permeability sensor 25 (i.e., the toner density of the developer stored in the developer tank 21), thereby controlling the supply of toner to the developer tank 21 and the amount of toner to be supplied. Moreover, the control device 110 stores therein correction coefficients for use in the toner supply and the computation of the amount of toner to be supplied.

Further, in such a developing device 200, the developer stored in the developer tank 21 is replaced with a brand-new developer by a service person either at the time of deterioration of the developer stored in the developer tank 21 or regularly. The toner density of the brand-new developer has been set to be lower than the value of density (hereinafter referred to as "target value") for use in an actual image formation job. Therefore, immediately after the replacement, the toner density of the developer stored in the developer tank 21 needs to be raised to the target value by performing a process of, immediately after replacement of the developer stored in the developer tank 21, correcting the toner density of the brand-new developer by supplying toner to the developer tank 21 (such a process being hereinafter referred to as "density correction process").

Accordingly, after replacement of the developer stored in the developer tank 21, the image forming apparatus 100 of the present embodiment performs the density correction process before performing an image formation process. The following describes the density correction process.

Figure 3:
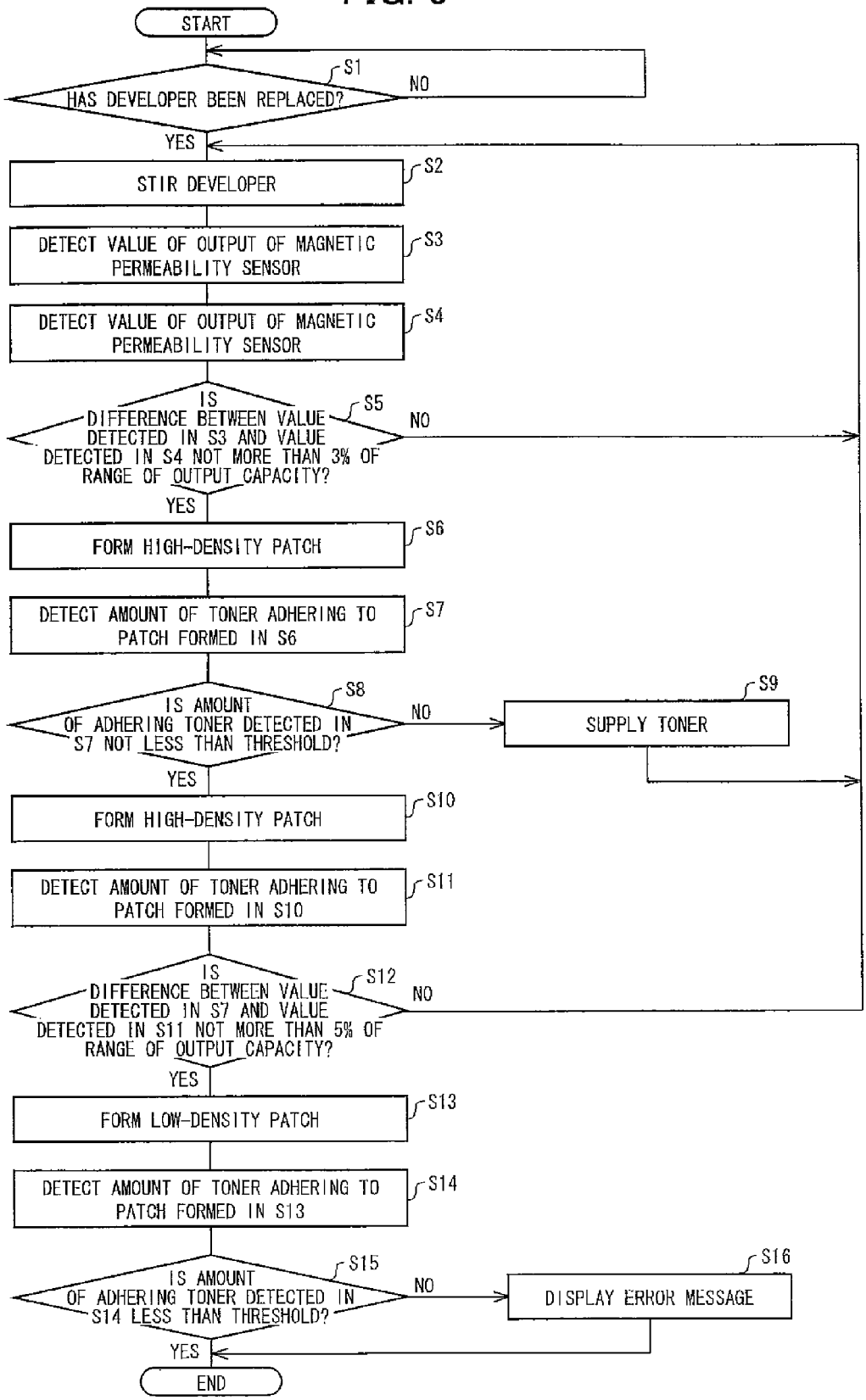
FIG. 3 is a flow chart showing a procedure for a post-replacement process that is performed after replacement of developers.

FIG. 3 is a flow chart showing a procedure for a process that is performed by the control device 110 after replacement of developers (such a process being hereinafter referred to as "post-replacement process"). It should be noted that the density correction process is included in the post-replacement process. In FIG. 3, Steps S1 through S16 correspond to the post-replacement process, and Steps S1 through S9 correspond to the density correction process.

As shown in FIG. 3, when the control device 110 detects replacement of the developer stored in the developer tank 21 with a brand-new developer (YES in Step S1), the control device 110 drives the driving sources of the developing roller 24, the supply roller 23, the stirring member 22, and the like, with the result that the developer stored in the developer tank 21 is stirred for a predetermined period of time (e.g., an amount of time required for the stirring member 22 to complete 20 turns) (Step S2). The purpose of this stirring is to saturate, with charge, the toner contained in the developer stored in the developer tank 21 and thereby stabilize the value of detection of the magnetic permeability sensor 25 regardless of the period of time for which the brand-new developer has been at rest. Further, in addition to stabilizing the value of detection of the magnetic permeability sensor 25, the stirring in Step S2 brings about an effect of reducing the scattering of toner at the time of toner supply in a later step. Since the amount of charge of toner contained in a developer having been at rest for a long time is remarkably low, the toner may be scattered at the time of stirring in Step S2. However, the scattering of toner in a later step can be reduced by raising the amount of charge of toner by stirring the developer at a low toner density, i.e., at a low coverage of carrier by toner.

If the image forming apparatus 100 is designed such that a service person in charge of the image forming apparatus 100 presses a default key or the like after replacement of the developer stored in the developer tank 21, the control device 110 can detect replacement of developers in Step S1 by the service person's pressing the default key or the like. Further, if the image forming apparatus 100 is designed such that a service person in charge of the image forming apparatus 100 resets a maintenance counter (brings the maintenance counter back to 0) after replacement of the developer stored in the developer tank 21, the control device 110 can detect replacement of developers in Step S1 by the service person's resetting the maintenance counter. Furthermore, the developer tank 21 may be provided with a fuse or the like that enables the control device 110 to discover that the developer is new.

The following describes Step S3 and subsequent steps. After the developer stored in the developer tank 21 has been stirred for a predetermined period of time in Step S2, the control device 110 detects the value of output of the magnetic permeability sensor 25 (Step S3). Then, the control device 110 detects the value of output of the magnetic permeability sensor 25 after a predetermined period of time has elapsed since Step S3 (Step S4). After Step S4, the control device 110 determines whether or not a difference between the value of output detected in Step S3 and the value of output detected in Step S4 is not more than a value corresponding to 3% of a range of output capacity of the magnetic permeability sensor 25 (i.e., of a difference between the maximum and minimum values of output capacity of the magnetic permeability sensor 25) (Step S5).

If the difference between the value of output detected in Step S3 and the value of output detected in Step S4 is higher than the value corresponding to 3% of the range of output capacity, the control device 110 repeats Steps S2 through S5 (NO in Step S5). That is, Steps S2 through S5 are repeated until the difference between the value of output detected in Step S3 and the value of output detected in Step S4 becomes not more than the value corresponding to 3% of the range of output capacity. This causes the developer stored in the developer tank 21 to be stirred repeatedly until the magnetic permeability sensor 25 comes to vary only slightly in value of output. This makes it possible to cause the density of toner in the developer tank 21 to be stable and uniform in Step 6 and subsequent steps.

In cases where it is determined that the difference between the value of output detected in Step S3 and the value of output detected in Step S4 is not more than the value corresponding to 3% of the range of output capacity (YES in Step S5), the control device 110 controls the exposure unit 11 and the developing device 200 so that a high-density patch is formed on the photoreceptor drum 3 (Step S6). The term "high-density patch (reference toner image)" here means a patch formed by developing an electrostatic latent image formed by exposing the photoreceptor drum 3 with 95% of the maximum output of the exposure unit 11.

Next, the control device 110 detects, in accordance with an output of the sensor 60, the amount of toner adhering to the high-density patch formed in Step S6 (Step S7), and then determines whether the detected amount of adhering toner is not less than a threshold (Step S8). It should be noted that the threshold set in Step S8 is a value corresponding to such an amount of adhering toner that a Macbeth densitometer reads an image density ID of 1.4.

In cases where the amount of toner adhering to the high-density patch is less than the threshold (NO in Step S8), the control device 110 controls the toner supply section 2 of the developing device 200 so that a predetermined amount of toner is supplied from the toner hopper 97 to the developer tank 21 (Step S9), and then repeats Steps S2 through S8. That is, the supply of toner into the developer tank 21 and the stirring of the developer stored in the developer tank 21 are repeated until the amount of toner adhering to a high-density patch formed on the photoreceptor drum 3 becomes not less than the threshold.

In cases where it is determined that the amount of toner adhering to the high-density patch is not less than the threshold (YES in Step S8), the control device 110 controls the exposure unit 11 and the developing device 200 so that another high-density patch is formed on the photoreceptor drum 3 (Step S10). Then, the control device 110 detects, in accordance with an output of the sensor 60, the amount of toner adhering to the high-density patch formed in Step S10 (Step S11). Furthermore, the control device 110 determines whether a difference between the amount of adhering toner detected in Step S7 and the amount of adhering toner detected in Step S11 is not more than a value corresponding to 5% of a range of output capacity of the sensor 60 (i.e., of a difference between the maximum and minimum values of output capacity of the sensor 60, predetermined value) (Step S11).

If the difference between the amount of adhering toner detected in Step S7 and the amount of adhering toner detected in Step S11 is higher than the value corresponding to 5% of the range of output capacity of the sensor 60, the control device 110 repeats Steps S2 through S12 (NO in Step S12). That is, Steps S2 through S12 are repeated until the difference between the amount of toner adhering to a high-density patch formed in Step S6 and the amount of toner adhering to a high-density patch formed in Step S10 becomes not more than the value corresponding to 5% of the range of output capacity of the sensor 60. This causes the developer stored in the developer tank 21 to be stirred repeatedly until high-density patches formed on the photoreceptor drum 3 come to vary only slightly in the amount of toner adhering thereto. This makes it possible to stabilize the amount of toner adhering to images that are developed by the developing device 200.

In cases where it is determined that the difference between the amount of adhering toner detected in Step S7 and the amount of adhering toner detected in Step S11 is not more than the value corresponding to 5% of the range of output capacity of the sensor 60 (YES in Step S12), the control device 110 controls the exposure unit 11 and the developing device 200 so that a low-density patch is formed on the photoreceptor drum 3 (Step S13). The term "low-density patch" here means a patch formed by developing an electrostatic latent image formed by exposing the photoreceptor drum 3 with 5% of the maximum output of the exposure unit 11.

Next, the control device 110 detects, in accordance with an output of the sensor 60, the amount of toner adhering to the low-density patch formed in Step S13 (Step S14), and then determines whether or not the detected amount of adhering toner is less than a threshold (Step S15). It should be noted that the threshold set in Step S14 is a value corresponding to such an amount of adhering toner that a Macbeth densitometer reads an image density ID of 0.05.

Furthermore, in cases where the amount of adhering toner detected in Step S14 is less than the threshold (YES in Step S15), the control device 110 terminates the post-replacement process. On the other hand, in cases where the amount of adhering toner detected in Step S14 is not less than the threshold (NO in Step S15), the control device 110 terminates the post-replacement process after display an error message on a display panel of the image forming apparatus 100. In the case of too large an amount of toner adhering to a low-density patch, it is possible that the developing device 200 has been broken down. Therefore, in cases where the amount of adhering toner detected in Step S14 is not less than the threshold, the error message is displayed.

In cases where the control device 110 terminates the post-replacement process (Steps S1 through S16) without displaying the error message, the control device 110 shifts to a standby mode for the image formation process so that the image formation process can be performed. This allows an operator of the image forming apparatus 100 to cause the image forming apparatus 100 to perform the image formation process on a sheet.

In cases where the error message is displayed in Step S15, the control device 110 does not shift to the standby mode for the image formation process. Then, in this case, the developing device 200 is inspected or repaired by a service person.

Such an image forming apparatus 100 as described above has: a photoreceptor drum 3; an exposure unit 11 that forms an electrostatic latent image on the photoreceptor drum 3 by exposing the photoreceptor drum 3; a developing device 200; a sensor 60 that detects the amount of toner adhering to a toner image formed on the photoreceptor drum 3; and a control device 110 that controls the operation of each of the photoreceptor drum 3, the exposure unit 11, the developing device 200, and the sensor 60. Moreover, the developing device 200 includes: a developer tank 21 in which a developer is stored; a supply section 2 that corrects the toner density of the developer by supplying toner to the developer tank 21; and a developing roller 24 that forms an toner image on the photoreceptor drum 3 by supplying, to an electrostatic latent image formed on the photoreceptor drum 3, toner contained in the developer stored in the developer tank 21.

Furthermore, the image forming apparatus 100 of the present embodiment is arranged such that after replacement of the two-component developer stored in the developer tank 21 (Step S1), the control device 110 performs a first formation step (Step S6) of forming a high-density patch on the photoreceptor drum 3, a first detection step (Step S7) of detecting the amount of toner adhering to the high-density patch, and a supply step (Step S9) of supplying a predetermined amount of toner to the developer tank 21 in cases where the amount of adhering toner detected in Steps S7 is less than a threshold. Further, the control device 110 performs a repetition process of repeating Steps S2 through S9 until the amount of adhering toner detected in Steps S7 becomes not less than the threshold. It should be noted here that the first detection step, the first formation step, the supply step, and the repetition process correspond to the density correction process.

Then, in the post-replacement process including the density correction process, a judgment about the supply of toner is made in accordance with the amount of toner adhering to a high-density patch actually formed on the photoreceptor drum 3. Therefore, in the present embodiment, the toner density of the developer stored in the developer tank 21 is adjusted so that the amount of toner adhering to a high-density patch formed on the photoreceptor drum 3 is optimized. This makes it possible to realize the optimum toner density for each image forming apparatus (i.e., such toner density of the developer that the density of an image formed on the photoreceptor drum 3 is optimized), regardless of variations, if any, in DSD and DG among image forming apparatuses, thereby making it possible to eliminate variations in halftone density among image forming apparatuses.

In other words, the toner density of the developer stored in the developer tank 21 can be adjusted to the optimum toner density for conditions (quality of each production lot) unique to the developer and conditions (development conditions such as DSD and DG) unique to the developing device 200. This makes it possible to stably form images having a certain level of halftone density. Further, the realization of the optimum toner density makes it possible to prevent carrier from adhering to the photoreceptor drum 3, thereby making it possible to stably form satisfactory images without white spots.

Figure 4:
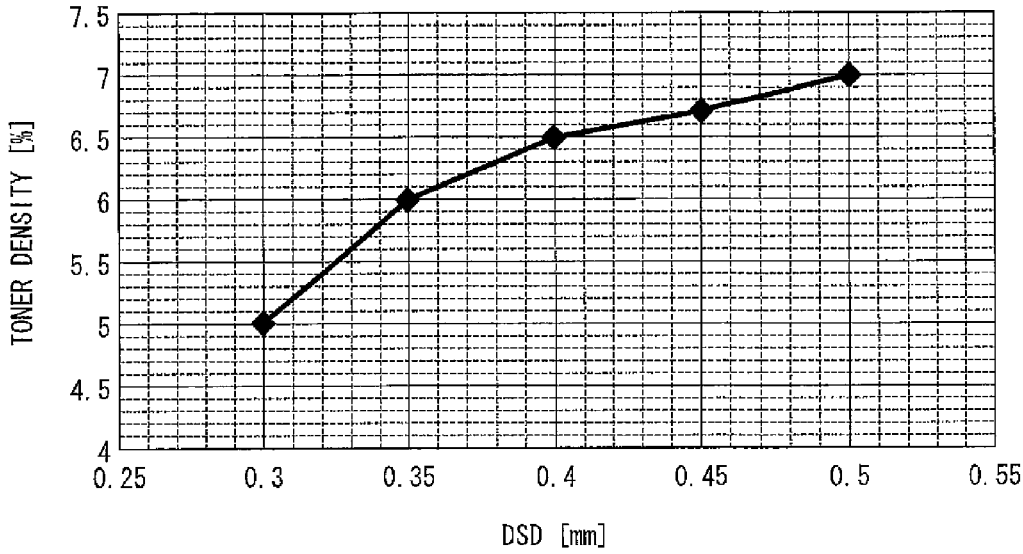
FIG. 4 is a graph showing, in the case of performance of the procedure of FIG. 3 with use of five image forming apparatuses having different DSDs, a relationship between the DSD of each image forming apparatus and the toner density of a developer stored in its developer tank.

FIG. 4 is a graph showing, in the case of performance of the procedure of FIG. 3 with use of five image forming apparatuses having different DSDs, a relationship between the DSD of each image forming apparatus and the toner density of a developer stored in its developer tank. It is assumed here that the toner density in each of the image forming apparatuses is 3% before the post-replacement process of FIG. 3 is performed in the image forming apparatus. As is clear from FIG. 4, if image forming apparatuses capable of performing the post-replacement process of the present embodiment have different DSDs, the image forming apparatuses will be finally adjusted to different levels of toner density.

Further, if the toner density of the developer immediately after replacement and the amount of toner that is supplied in Step S9 (predetermined amount) are set to take on such values that the toner supply step S9 only needs to be performed once, the amount of time required to finish the density correction process of FIG. 3 can be reduced. However, it is preferable that the toner density of the developer immediately after replacement and the amount of toner that is be supplied in Step S9 be set so that the toner supply step S9 is performed more than once. The following gives a reason for this. If a large amount of toner is supplied at once into the developer stored in the developer tank 21, uncharged toner may scatter. On the other hand, if a small amount of toner is supplied more than once (e.g., three times), uncharged toner can be prevented from scattering. This makes it possible to more stably form images having a certain level of image density. Further, supplying a small amount of toner more than once means gradually raising the toner density of the developer stored in the developer tank 21, thus suppressing an excessive rise in toner density.

Figure 5:
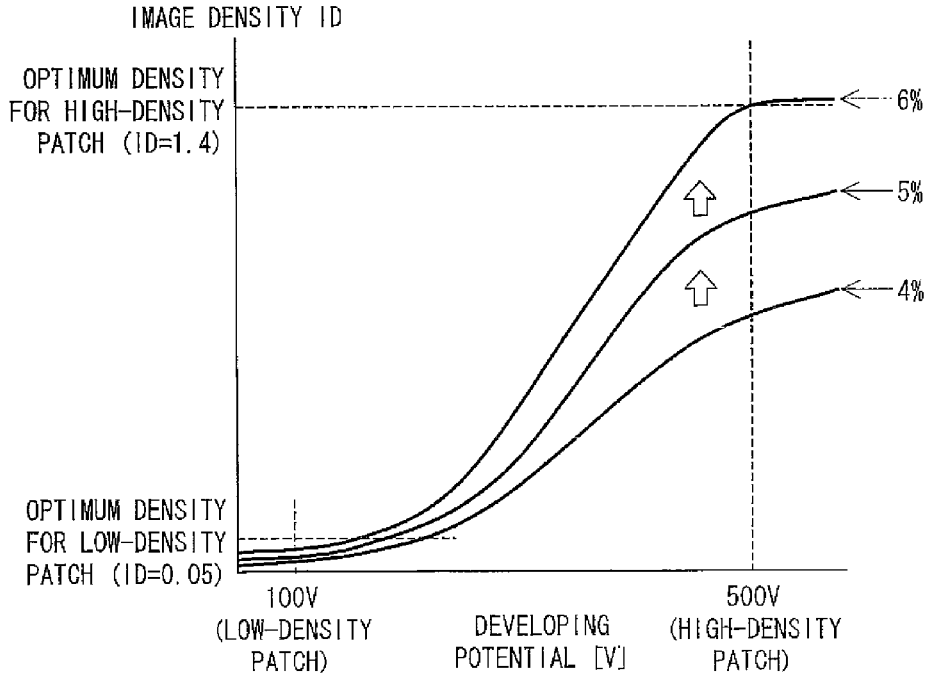
FIG. 5 is a graph showing a relationship between the developing potential and image density ID of images developed in cases where the toner density of a two-component developer is 4%, 5%, and 6%, respectively.
Figure 6:
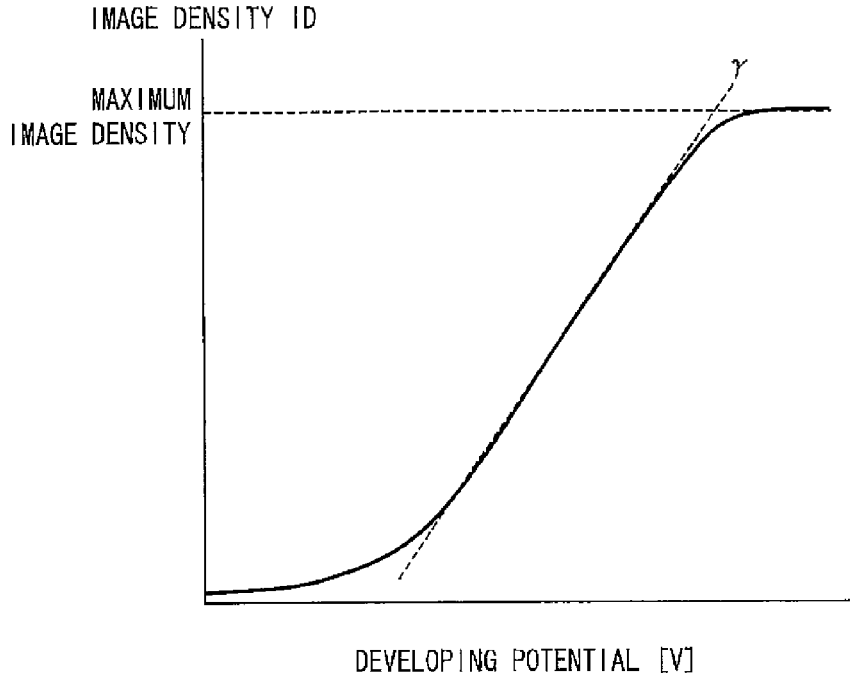
FIG. 6 is a graph showing a relationship between the developing potential and image density ID of an image formed in cases where the toner density of a two-component developer is appropriate.
Figure 7:
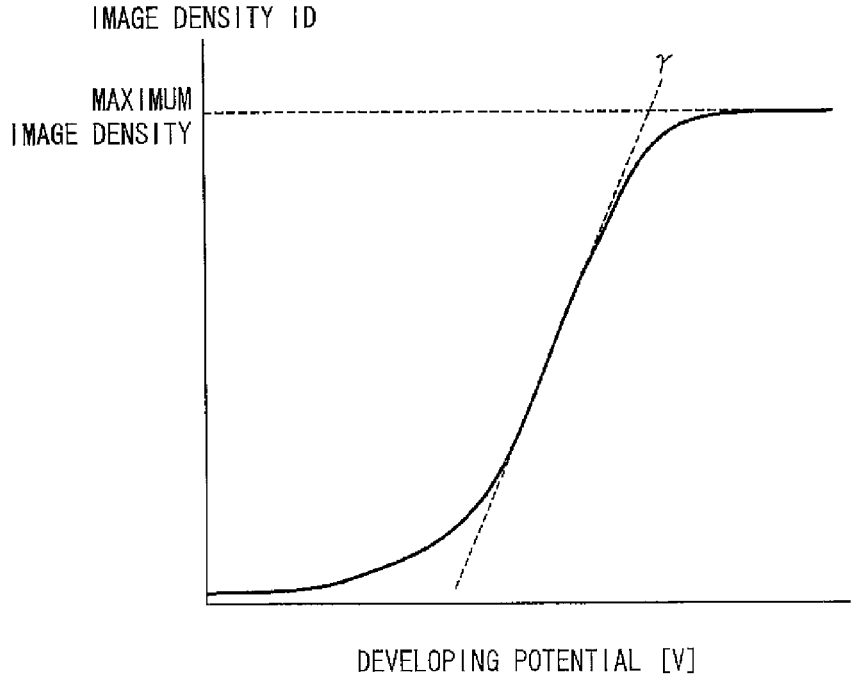
FIG. 7 is a graph showing a relationship between the developing potential and image density ID of an image formed in cases where the toner density of a two-component developer is higher than the optimum value.
Figure 8:
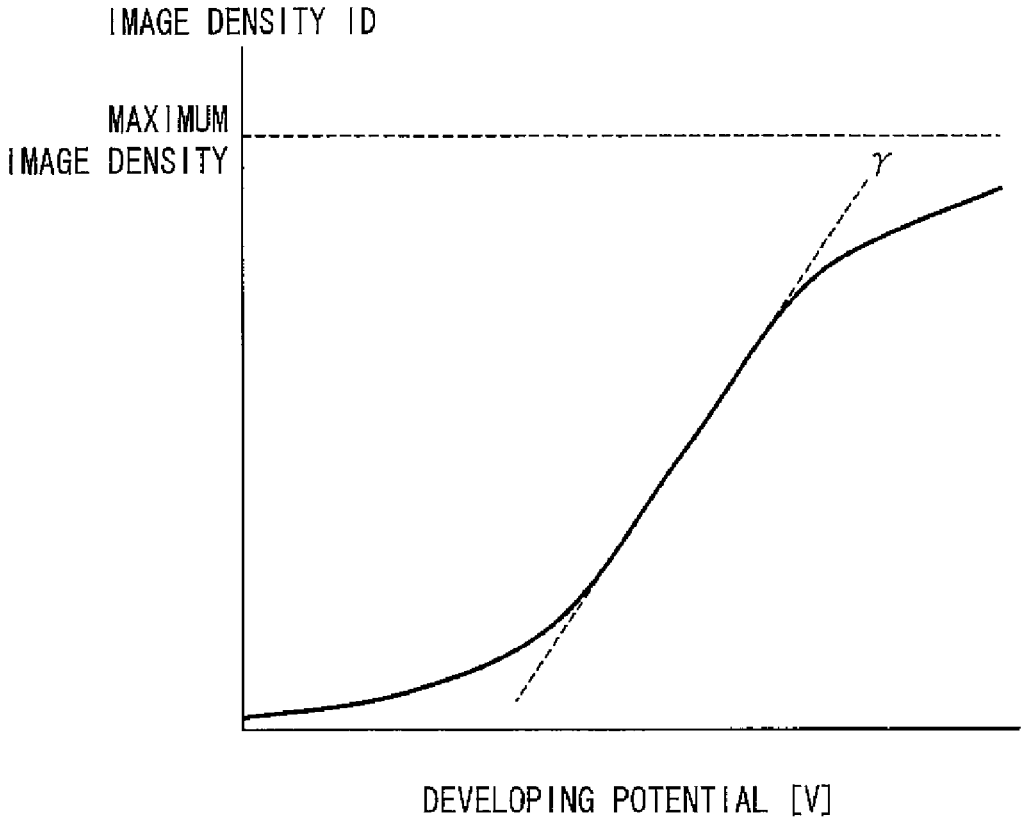
FIG. 8 is a graph showing a relationship between the developing potential and image density ID of an image formed in cases where the toner density of a two-component developer is lower than the optimum value.

FIG. 5 is a graph showing a relationship between the developing potential and image density ID of images developed in cases where the toner density of a developer is 4%, 5%, and 6%, respectively. The term "developing potential" in FIG. 5 means the absolute value of a difference between the surface potential of the photoreceptor drum 3 and the potential of the developing roller 24. Further, the high-density patch of FIG. 5 is formed at a developing potential of 500 V with 95% of the maximum output of the exposure unit 11, and the low-density patch of FIG. 5 is formed at a developing potential of 100 V with 5% of the maximum output of the exposure unit 11.

The graph in FIG. 5 shows three curves respectively representing a toner density of 4%, a toner density of 5%, and a toner density of 6%. The curve representing a toner density of 4% is a curve representing a brand-new developer. The curve representing a toner density of 5% is a curve representing a developer obtained by supplying toner to the brand-new developer once. The curve representing a toner density of 6% is a curve representing a developer obtained by supplying toner to the brand-new developer twice. As shown in FIG. 5, supplying a small amount of toner more than once (twice in FIG. 5) makes it possible to gradually raise the toner density of the developer. This makes it possible to adjust the toner density of the developer so that the image density ID of a high-density patch and the image density ID of a low-density patch are nearly optimized. On the other hand, in cases where a large amount of toner is supplied at once into the developer, the toner density of the developer may be adjusted so that the image density ID of a high-density patch and the image density ID of a low-density patch are well over the optimum values.

It should be noted that it is preferable that the toner density of a developer immediately after replacement (brand-new developer) be set so as to take on a value corresponding to 60% to 90% of the target value of density (i.e., the density after the post-replacement process). The reason for this is as follows: If the toner density of a developer immediately after replacement has been set in the order of 60% to 90% of the target value of density, it is possible to suppress a difference in properties of two-component developer between before and after replacement.

Further, in cases where the toner density of a developer immediately after replacement is set so as to take on a value corresponding to 60% to 90% of the target value of density, it is preferable that the amount of toner that is supplied in the toner supply step S9 be set so that the toner density of the developer stored in the developer tank 21 is raised by 0.3% to 0.5%. In such a setting, the toner supply step S9 will be repeated more than once regardless of the values of DG and DSD.

The output of the exposure unit 11 at the time of formation of a high-density patch is not limited to 95% of the maximum output, and only needs to range between 95% and 100% of the maximum output. The output of the exposure unit 11 at the time of formation of a low-density patch is not limited to 5% of the maximum output, and only needs to range between 0% and 5% of the maximum output.

According to the present embodiment, in cases where the amount of adhering toner detected in Step S7 is not less than the threshold (YES in Step S8), a second formation step (Step S10) of forming another high-density patch on the photoreceptor drum 3 and a second detection step (Step S11) of detecting the amount of toner adhering to the high-density patch formed in Step S10 are performed. Then, in cases where the difference between the amount of toner, detected in Step S7, which is not less than the threshold and the amount of toner detected in Step S11 exceeds a value (predetermined value) corresponding to 5% of the range of output capacity of the sensor 60, Steps S2 through S12 are performed again. This causes the stirring step S2 and the supply of toner to be repeated until a plurality of high-density patches formed on the photoreceptor drum 3 come to vary only slightly in the amount of toner adhering thereto. This makes it possible to stabilize the density of images that are developed.

According to the flow chart of FIG. 3, it is determined whether the amount of adhering toner is not less than the threshold (Step S8), and the supply of toner is repeated until the amount of adhering toner becomes not less than the threshold. The phrase "not less than the threshold" here may mean the threshold and a value larger than the threshold, or may mean a value exceeding the threshold.

Although the image forming apparatus 100 is arranged in the present embodiment as a printer that forms a monochrome image, the image forming apparatus 100 is not limited to such a printer, and may be arranged as a printer that forms a multicolor image (color image), a copying machine, a facsimile, etc.

The following details the experiment conducted by using the image forming apparatus 100 of the present embodiment.

EXAMPLES OF EXPERIMENT

The experiment was conducted by using Examples 1 to 3 and Comparative Examples 1 to 3 shown below.

Example 1

A continuous printing test was conducted by using a two-component developer in an image forming apparatus 100 capable of performing the post-replacement process of FIG. 3. As test paper sheets, A4 recording media (Multi-receiver: Sharp Document System Corporation) for electrophotographic apparatuses were used. The continuous printing test was conducted in a normal-humidity environment, i.e., at a temperature of 25° C. with a humidity of 60%. In Example 1 of Experiment, the set value of DSD was 0.4 mm (design median).

It should be noted that the continuous printing test is a process in which 5,000 text images are printed so that the coverage of a print image that is formed on a test paper sheet, i.e., the coverage by toner of a region where an image can be formed is 6% and the image density ID and the amount of toner consumed are measured every 1,000 prints.

Example 2

A continuous printing test was conducted in the same manner as in Example 1, except that the set value of DSD was 0.3 mm.

Example 3

A continuous printing test was conducted in the same manner as in Example 1, except that the set value of DSD was 0.5 mm.

Comparative Example 1

A continuous printing test was conducted in the same manner as in Example 1, except that an image forming apparatus 100 incapable of performing the post-replacement process of FIG. 3 was used.

Comparative Example 2

A continuous printing test was conducted in the same manner as in Example 2, except that the image forming apparatus 100 incapable of performing the post-replacement process of FIG. 3 was used.

Comparative Example 3

A continuous printing test was conducted in the same manner as in Example 3, except that the image forming apparatus 100 incapable of performing the post-replacement process of FIG. 3 was used.

(Criteria for Evaluation of the Image Density ID)

Every 1,000 prints, a solid image (having a density of 100%) with the dimensions 5 cm×5 cm was printed, and the image density ID of the solid image was measured by a Macbeth densitometer (RD 918). The criteria for evaluation of the image density ID were as follows:

A (Good): Image density ID of not less than 1.30; sufficient coverage of paper fiber by toner.

B (Inferior): Image density ID of not less than 1.20 to less than 1.30; moderately appropriate coverage of paper fiber by toner.

C (Defective): Image density ID of less than 1.20; insufficient coverage of paper fiber by toner.

(Criteria for Evaluation of the Amount of Toner Consumed)

The amount of toner consumed by printing text images in the print test described in Example 1 was measured. The criteria for evaluation of the amount of toner consumed were as follows:

A (Good): The amount of toner consumed is not more than 20 g per 1,000 prints.

B (Inferior): The amount of toner consumed is not more than 25 g per 1,000 prints.

C (Defective): The amount of toner consumed is more than 25 g per 1,000 prints.

(Results of the Continuous Printing Tests)

Table 1 below shows the results of the evaluation of the image density ID in each of the continuous printing tests conducted in Examples 1 to 3 and Comparative Examples 1 to 3. Table 2 below shows the results of the evaluation of the amount of toner consumed in each of the continuous printing tests conducted in Examples 1 to 3 and Comparative Examples 1 to 3.

TABLE 1

| | DSD | Post-replacement process (Density correction process) | First | 1,000th | 2,000th | 3,000th | 4,000th | 5,000th |
|---|---|---|---|---|---|---|---|---|
| Ex. 1 | 0.4 | Done | A | A | A | A | A | A |
| Ex. 2 | 0.3 | Done | A | A | A | A | A | A |
| Ex. 3 | 0.5 | Done | A | A | A | A | A | A |
| Comp. Ex. 1 | 0.4 | NA | A | A | A | A | A | A |
| Comp. Ex. 2 | 0.3 | NA | A | A | A | A | A | A |
| Comp. Ex. 3 | 0.5 | NA | C | C | C | C | B | A |

TABLE 2

| | DSD | Post-replacement process (Density correction process) | 0 to 1,000 | 1,000 to 2000 | 2,000 to 3,000 | 3,000 to 4,000 | 4,000 to 5,000 |
|---|---|---|---|---|---|---|---|
| Ex. 1 | 0.4 | Done | A | A | A | A | A |
| Ex. 2 | 0.3 | Done | A | A | A | A | A |
| Ex. 3 | 0.5 | Done | A | A | A | A | A |

TABLE 2-continued

| | DSD | Post-replacement process (Density correction process) | 0 to 1,000 | 1,000 to 2000 | 2,000 to 3,000 | 3,000 to 4,000 | 4,000 to 5,000 |
|---|---|---|---|---|---|---|---|
| Comp. Ex. 1 | 0.4 | NA | A | A | A | A | A |
| Comp. Ex. 2 | 0.3 | NA | C | C | C | B | A |
| Comp. Ex. 3 | 0.5 | NA | A | A | A | A | A |

As shown in Tables 1 and 2, the results of the continuous printing tests show that up to 5,000 images formed by the image forming apparatus 100 capable of performing the post-replacement process of FIG. 3 were satisfactory in both image density ID and amount of toner consumed. On the other hand, images formed by the image forming apparatus incapable of performing the post-replacement process of FIG. 3 decreased in initial image density or increased in amount of toner consumption in cases where the DSD deviated from the design value as in Comparative Examples 2 and 3, albeit not decreasing in initial image density or increasing in amount of toner consumption in cases where the DSD took on the design median as in Comparative Example 1.

An image forming apparatus of the present embodiment includes: a photoreceptor; an exposure device that forms an electrostatic latent image on the photoreceptor by exposing the photoreceptor; a developing device including (i) a developer tank in which a two-component developer containing toner and carrier has been stored and (ii) a developing roller that forms a toner image on the photoreceptor by supplying, to the electrostatic latent image formed on the photoreceptor, the toner contained in the two-component developer stored in the developer tank; a supply device that corrects a toner density of the two-component developer by supplying toner to the developer tank; a detection device that detects an amount of toner of the toner image formed on the photoreceptor; and a control device that controls operation of each of the photoreceptor, the exposure device, the developing device, the supply device, and the detection device, upon detection of replacement of the two-component developer stored in the developer tank, the control device controlling the operation so that a density correction process is performed, the density correction process being a process, including (a) a first formation step of forming a reference toner image on the photoreceptor, (b) a first detection step of detecting an amount of toner of the reference toner image, and (c) a supply step of supplying a predetermined amount of toner to the developer tank when the amount of toner detected in the first detection step is less than a threshold, by which process the supply step, the first formation step, and the first detection step are repeated in this order until the amount of toner detected in the first detection step becomes not less than the threshold.

The image forming apparatus of the present invention is arranged such that immediately after replacement of the two-component developer, toner is supplied into the developer tank so that the amount of toner adhering to a reference toner image actually formed on the photoreceptor reaches the threshold. Therefore, the image forming apparatus of the present embodiment is arranged such that the toner density of the two-component developer stored in the developer tank is adjusted so that the density of a reference toner image that is formed on the photoreceptor takes on the desired value.

This makes it possible that even if there are variations in DSD and DG among image forming apparatuses, the optimum toner density (i.e., such toner density of the two-component developer that the density of an image formed on the photoreceptor takes on the optimum value) is realized for each image forming apparatus regardless of the variations. In other words, the present embodiment is such that immediately after replacement of the two-component developer, the toner density of the developer stored in the developer tank 21 is adjusted to the optimum value for conditions (quality of each production lot) unique to the developer and conditions (development conditions such as DSD and DG) unique to the developing device. This makes it possible that even immediately after replacement of the two-component developer, images having a certain level of density can be stably formed, thus stabilizing image quality.

Further, in such a case that the toner density is raised at once to not less than the threshold by performing the supply step only once, there is a danger that the toner density becomes excessively high. On the other hand, the image forming apparatus of the present invention is arranged such that the supply step, the first formation step, and the first detection step are repeated in this order until the amount of toner detected in the first detection step becomes not less than the threshold. Therefore, if the present invention is arranged such that the predetermined amount and the toner density of the developer immediately after replacement are defined so that the supply step is performed more than once, it is possible to gradually raise the toner density of the developer stored in the developer tank, instead of raising the toner density at once. This makes it possible to lessen the danger of an excessive rise in toner density.

The image forming apparatus of the present embodiment is preferably arranged such that the reference toner image is an image obtained by developing an electrostatic latent image formed by exposing the photoreceptor with 95% to 100% of maximum output of the exposure device.

Further, The image forming apparatus of the present embodiment is preferably arranged such that a toner density of a two-component developer to be newly stored in the developer tank by the replacement is 60% to 90% of the toner density of the two-component developer stored in the developer tank after the density correction process. This makes it possible to suppress a difference in properties of the two-component developer between before and after replacement.

Furthermore, the image forming apparatus of the present embodiment is preferably arranged such that the predetermined amount is such an amount that the toner density of the two-component developer stored in the developer tank is raised by 0.3% to 0.5%. This makes it possible to repeat the supply step more than once, to gradually raise the toner density of the developer stored in the developer tank, and to lessen the danger of an excessive rise in toner density.

Further, the image forming apparatus of the present embodiment is preferably arranged such that: when the amount of toner detected in the first detection step is not less than the threshold, the control device controls the operation so that a second formation step of forming the reference toner image on the photoreceptor and a second detection step of detecting an amount of toner of the reference toner image formed in the second formation step are performed; and when a difference between the amount of toner, detected in the first detection step, which is not less than the threshold and the amount of toner detected in the second detection step exceeds a predetermined value, the control device controls the operation so that the density correction process is performed again after the two-component developer stored in the developer tank has been stirred. This causes the stirring and the density correction process to be repeated until a plurality of reference patches formed on the photoreceptor drum 3 come to vary only slightly in the amount of toner adhering thereto. This makes it possible to stabilize the density of images that are developed.

An image forming apparatus of the present invention is suitable for an electrophotographic printer, a copying machine, a multifunction printer, and a facsimile.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus comprising:

a photoreceptor;

an exposure device that forms an electrostatic latent image on the photoreceptor by exposing the photoreceptor;

a developing device including (i) a developer tank in which a two-component developer containing toner and carrier has been stored and (ii) a developing roller that forms a toner image on the photoreceptor by supplying, to the electrostatic latent image formed on the photoreceptor, the toner contained in the two-component developer stored in the developer tank;

a supply device that corrects a toner density of the two-component developer by supplying toner to the developer tank;

a detection device that detects an amount of toner of the toner image formed on the photoreceptor; and a control device that controls operation of each of the photoreceptor, the exposure device, the developing device, the supply device, and the detection device, upon detection of replacement of the two-component developer stored in the developer tank, the control device controlling the operation so that a density correction process is performed, the density correction process being a process, including (a) a formation first step of forming a reference toner image on the photoreceptor, (b) a detection first step of detecting an amount of toner of the reference toner image, and (c) a supply step of supplying a predetermined amount of toner to the developer tank when the amount of toner detected in the first detection step is less than a threshold, by which process the supply step, the formation first step and the first detection step are in this order until the amount of toner detected in the first detection step becomes not less than the threshold, wherein:

when the amount of toner detected in the first detection step is not less than the threshold, the control device controls the operation so that a second formation step of forming the reference toner image on the photoreceptor and a second detection step of detecting an amount of toner of the reference toner image formed in the second formation step are performed; and when a difference between the amount of toner, detected in the first detection step, which is not less than the threshold and the amount of toner detected in the second detection step exceeds a predetermined value, the control device controls the operation so that the density correction process is performed again after the two-component developer stored in the developer tank has been stirred.

2. The image forming apparatus as set forth in claim 1, wherein the reference toner image is an image obtained by developing an electrostatic latent image formed by exposing the photoreceptor with 95% to 100% of maximum output of the exposure device.

3. The image forming apparatus as set forth in claim 1, wherein a toner density of a two-component developer to be newly stored in the developer tank by the replacement is 60% to 90% of the toner density of the two-component developer stored in the developer tank after the density correction process.

4. The image forming apparatus as set forth in claim 3, wherein the predetermined amount is such an amount that the toner density of the two-component developer stored in the developer tank is raised by 0.3% to 0.5%.

5. A method for correcting density in an image forming apparatus including:

a photoreceptor;

an exposure device that forms an electrostatic latent image on the photoreceptor by exposing the photoreceptor;

a developing device including (i) a developer tank in which a two-component developer containing toner and carrier has been stored and (ii) a developing roller that forms a toner image on the photoreceptor by supplying, to the electrostatic latent image formed on the photoreceptor, the toner contained in the two-component developer stored in the developer tank;

a supply device that corrects a toner density of the two-component developer by supplying toner to the developer tank; and a detection device that detects an amount of toner of the toner image formed on the photoreceptor, the method comprising the step of, when the two-component developer stored in the developer tank has been replaced, performing a density correction process, the density correction process being a process, including (a) a formation step of forming a reference toner image on the photoreceptor, (b) a detection step of detecting an amount of toner of the reference toner image, and (c) a supply step of supplying a predetermined amount of toner to the developer tank when the amount of toner detected in the detection step is less than a threshold, by which process the supply step, the formation step, and the detection step are repeated in this order until the amount of toner detected in the detection step becomes not less than the threshold, wherein:

when the amount of toner detected in the first detection step is not less than the threshold, the control device controls the operation so that a second formation step of forming the reference toner image on the photoreceptor and a second detection step of detecting an amount of toner of the reference toner image formed in the second formation step are performed; and when a difference between the amount of toner, detected in the first detection step, which is not less than the threshold and the amount of toner detected in the second detection step exceeds a predetermined value, the control device controls the operation so that the density correction process is performed again after the two-component developer stored in the developer tank has been stirred.

* * * * *